US006254444B1

(12) United States Patent
Nordby

(10) Patent No.: US 6,254,444 B1
(45) Date of Patent: Jul. 3, 2001

(54) CONTOURED PADDLE FOR WATER SPORTS

(76) Inventor: Willard E. Nordby, 5 Carmel Dr., Novato, CA (US) 94945

( * ) Notice: Subject to any disclaimer, the term of this patent is extended or adjusted under 35 U.S.C. 154(b) by 0 days.

(21) Appl. No.: 09/387,541

(22) Filed: Aug. 30, 1999

(51) Int. Cl.[7] ..... B63H 16/04
(52) U.S. Cl. ..... 440/101; 416/70 R; 416/74
(58) Field of Search ..... 440/101; 416/74, 416/70 R; D12/215

(56) References Cited

U.S. PATENT DOCUMENTS

| | | | | |
|---|---|---|---|---|
| 358,034 | * | 2/1887 | Green . | |
| 408,482 | * | 8/1889 | Hicks . | |
| 4,820,216 | * | 4/1989 | Masters | 440/101 |
| 5,482,434 | * | 1/1996 | Heaven | 440/101 |

FOREIGN PATENT DOCUMENTS

| | | | | |
|---|---|---|---|---|
| 26 04 597 A 1 | * | 8/1977 | (DE) | 440/101 |
| 43 20 217 A 1 | * | 2/1991 | (DE) | 440/101 |
| 43 00 324 A 1 | * | 7/1994 | (DE) | 440/101 |
| 2 234 932 | * | 2/1991 | (GB) | 440/101 |
| 2 261 418 | * | 5/1993 | (GB) . | |

* cited by examiner

*Primary Examiner*—Sherman Basinger
(74) *Attorney, Agent, or Firm*—Larry D. Johnson; Craig M. Stainbrook; Johnson & Stainbrook, LLP

(57) ABSTRACT

An improved paddle for use with shallow draft watercraft, including kayaks, canoes, rafts, and the like, having a paddle blade with surface topography for geometrically channeling water across the surface of the blade when in use so as to reduce user fatigue and increase efficiency. A second embodiment of said paddle incorporates a crooked loom to increase leverage applied to said paddle blade by altering the stroke force from 90 degrees to 45 degrees.

21 Claims, 4 Drawing Sheets

CONTOURED PADDLE FOR WATER SPORTS

BACKGROUND OF THE INVENTION

1. Field of the Invention

The present invention relates generally to paddles for water sports, and more particularly to a paddle having a crooked loom and a blade with a surface topography, said paddle adapted for use with shallow draft watercraft, including kayaks, canoes, rafts, skiffs, and the like.

2. Description of the Prior Art

In recent years improved boating technology has made many water sports more accessible to the general public. Competitive water sports and recreational activities such as canoeing, rafting, kayaking, rowing, and the like, are growing in popularity, and with this increase in popularity there is an increasingly discriminating core of consumers who purchase the most advanced and efficient equipment.

Along with developments in boat hull design, there have been corresponding developments in the means to manually propel boats; namely, in the design of oars and paddles. These developments derive from a swiftly growing body of knowledge in biomechanics and fluid flow principles and fluid mechanics. However, the developments also derive from the purely empirical findings of expert users, viz., competitive racers and serious recreational enthusiasts.

Predictably, then, improvements in paddle and oar design have focused on making the instruments more efficient in reducing resistance, induced drag, and the load and strain on the user, while increasing propulsive force and the ease of directional control. Improvements relate to both paddle and oar blades and their shafts (looms) and handles. Examples of recent paddle developments include the following:

Hagihara U.S. Pat. No. 5,846,053 discloses a paddle blade having a surface designed to lock water on the paddling surface, said means comprising a plurality of circular, elliptical or polygonal hollows formed and arranged on the paddling surface in rows or a grid pattern.

Franznick U.S. Pat. No. 5,842,830 teaches a kayak paddle with a wooden shaft having reduced weight and improved strength. The shaft is formed of lineal segments running the length of the shaft and joined to form a closed shaft structure. A twist may be introduced in the shaft to established any desired feathering of the blades.

Killen et al., U.S. Pat. No. 5,830,024 discloses a paddle having one blade and a lateral force transmitting steering rib projecting from one of the blade side faces. The lateral force transmitting steering rib extends from the free terminal end of the paddle blade at right angles to the blade and extends longitudinally a distance of about one third to one half the length of the blade. It is intended to enable the user to paddle small boats on one side of the boat for both propulsion and course correction without necessitating the traditional "J" stroke, wherein the conventional paddle is turned outward at the end of the stroke.

Steinhour et al., U.S. Pat. No. 5,820,424 teaches an ergonomically improved kayak paddle having grips conformed to the closed hand of the user and connected proximal to the paddle blade at an angle of five to ten degrees from the shaft.

Lindeberg et al., U.S. Pat. No. 4,737,126 discloses a paddle or oar having a blade with an asymmetrical curved cross section throughout substantially the whole of the blade. The shape utilizes suction forces resulting from the passage of water over the surface of the blade so as to reduce displacement of the paddle caused by turbulence and eddy currents. It is specifically adapted for use with modern paddling techniques.

Harvey U.S. Pat. No. 4,673,361 teaches a canoe or kayak paddle having a crossbar structure such that when incorporated in either a single or double blade structure both hands grip crossbars when stroking on either side of the canoe or kayak.

While the foregoing inventions represent significant advances over their relatively primitive predecessors, paddle design has not nearly reached its potential for efficiency and ease of use.

SUMMARY OF THE INVENTION

Accordingly, the present invention relates to an improved paddle adapted for use with shallow draft watercraft, such as kayaks, canoes, rafts, skiffs, and the like, said paddle comprising a loom and at least one blade, said blade having an asymmetrical surface topography comprising channel dividers and fluted channels defined thereby for channeling water across the front surface of the blade when in use. The fluted channels direct water both longitudinally and transversely, and in combinations thereof, across the blade surface. Most importantly, the channeling conducts the water across the "sweet spot," locus, or center of force of the blade, and thereafter broadcasts the water away from the center. This pattern dramatically increases the propulsive effect of the stroke while evenly distributing torsional forces acting on the blade. In addition, the upper a edge of the blade has curled sections to maximize gripping the water throughout the duration of a paddle stroke. The back surface of the blade is not contoured, and the blade may be either substantially flat or gently curved in profile.

The present invention may be embodied in either single or double-bladed form, suitable, e.g., for canoeing or kayaking, respectively. A second embodiment of the present invention includes a crooked loom, again suitable for either single or double-bladed versions. The loom is crooked (angled) at its distal end, immediately interior to its connection to the blade, and angled at a substantially 45 degree angle from the longitudinal axis of the loom. This configuration alters the stroke force applied to the blade from the conventional 90 degrees to substantially 45 degrees, thereby increasing leverage. The crooked loom may be employed in either a standard or a feathered double-bladed paddle.

DETAILED DESCRIPTION OF A PREFERRED EMBODIMENT

Figure 1:
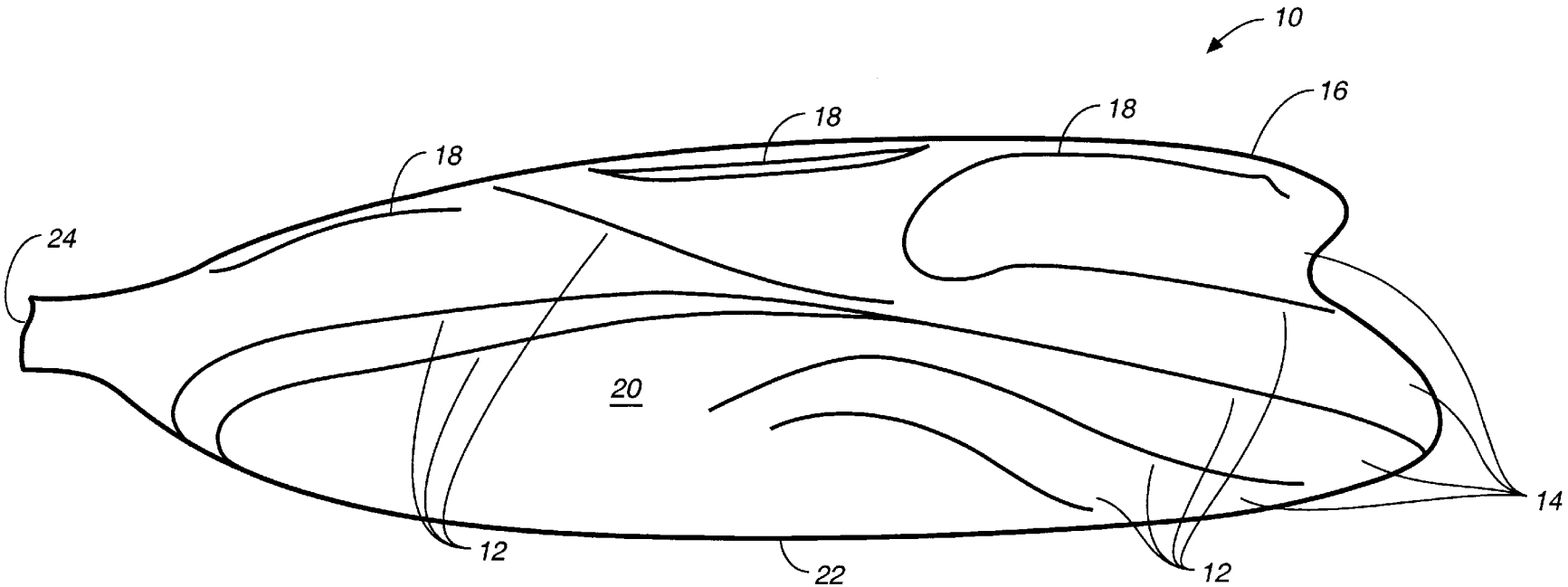
FIG. 1 is a side elevation view of the right front paddle blade face of the present invention.

FIG. 1 is a side elevation view of the right front paddle blade face of the present invention. This view shows that the blade, generally denominated 10, has an asymmetrical contoured surface, or topography, comprised of channel dividers 12 and correspondingly formed fluted channels 14 for directing water across the front surface of the blade when in use. Said fluted channels conduct water both longitudinally and transversely, and in combinations thereof, across the blade surface. Most importantly, the channeling conducts the water across the locus or center of propulsive force of the blade. This spot is effectively the "sweet spot" of the blade. After the channeled water crosses the sweet spot, the channels broadcast water away from the center, then to and from the edges of the blade in a balanced fashion. This pattern dramatically increases the propulsive effect of the stroke while mitigating torsional forces acting on the blade. Just as importantly, user fatigue is reduced by having a stabilized blade.

In addition to the surface topography defining the interior region of the blade, the upper edge of the blade 16 has curled sections 18 for gripping the water at the front surface 20 of the blade. The bottom edge 22 is rounded and beveled. The back surface of the blade, not shown, is not contoured and is essentially smooth. The blade may be either substantially flat or curved when viewed from above in its profile aspect. At its proximal end 22, said blade connects to the paddle loom, which is an extension of the blade's longitudinal axis.

Figure 2:
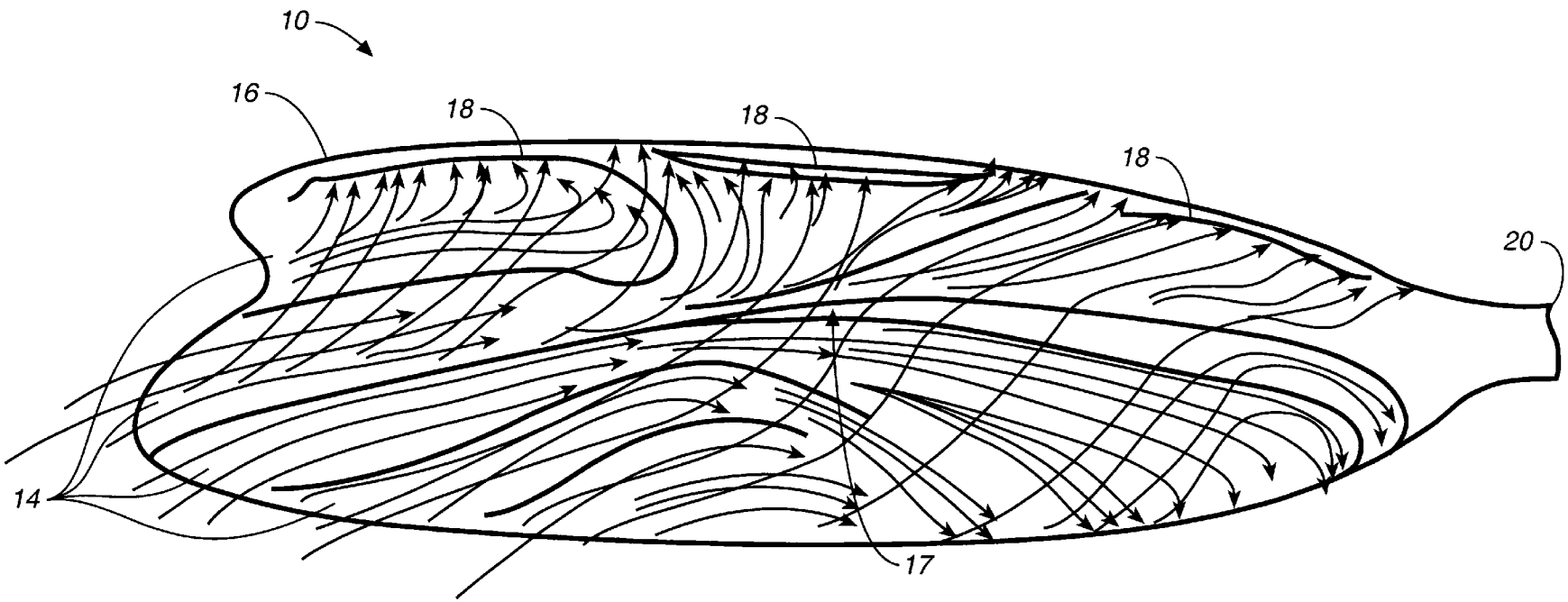
FIG. 2 is a side elevation view of the left front paddle blade face of the present invention, illustrating the hydrodynamic water flow over the topographic blade surface when in use.

FIG. 2 is a side elevation view of the left front paddle blade face of the present invention, illustrating the hydrodynamic water flow over the topographic front blade surface when in use. The topography of the blade responds dynamically to water resistance as indicated in the directional arrows of this view. Excessive drag produced by rapid acceleration of the paddle through the water reduces efficiency and increases load and strain on the user. Much of the drag is produced by turbulence and eddies formed around the blade edges. As can be appreciated from this drawing, the surface topography of the paddle blade of the present invention reduces drag by channeling water across the entire front surface of the blade, particularly including the geometric center 17 of the blade. As the blade 10 moves against water resistance, fluid pressure is distributed across the geometric center; the pressure is evenly sustained as it meets the curled sections 18 of the upper edge 16. By directing, accelerating, and dissipating fluid pressures geometrically across the blade, efficiency and stroke production are increased, and user strain and fatigue are reduced.

Just as paddles and oars are employed for a variety of purposes, the precise surface topography of the blade front may be varied according to the intended use, from competitive racing to recreational touring.

Figure 3A:
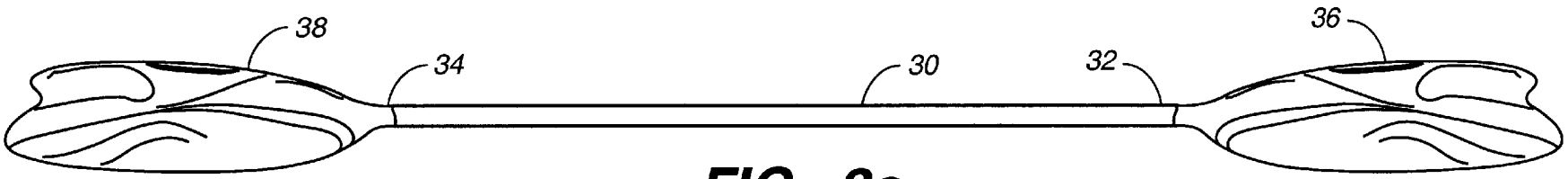
FIG. 3*a* is a side elevation view of an unfeathered double-paddled embodiment of the present invention, illustrating a standard shaft or loom.

FIG. 3*a* is a side elevation view of an unfeathered double-bladed embodiment of the present invention, illustrating a standard shaft or loom 30. Kayak paddles are frequently "feathered," meaning that the blades connected at each end of the loom are angled relative to one another on the plane of the longitudinal axis of the loom. The blades may be angled and any number of angles between 0 and 90 degrees, depending upon the preferences and/or needs of the user. The objective of feathering is to minimize wind resistance from the elevated and exposed blade while the other blade is submerged and propelling the craft; and secondarily to accomplish this while minimizing fatigue and strain to the user. In another embodiment, not illustrated, the blades of the present invention may be feathered. The feathered configuration does not affect the performance of the blades in the water.

FIG. 3*a* shows that the double-paddled embodiment comprises a substantially straight loom 30 having a right end 32 and a left end 34, and interposed between and connected at its distal ends to a right paddle blade 36 and a left paddle blade 38.

Figure 3B:
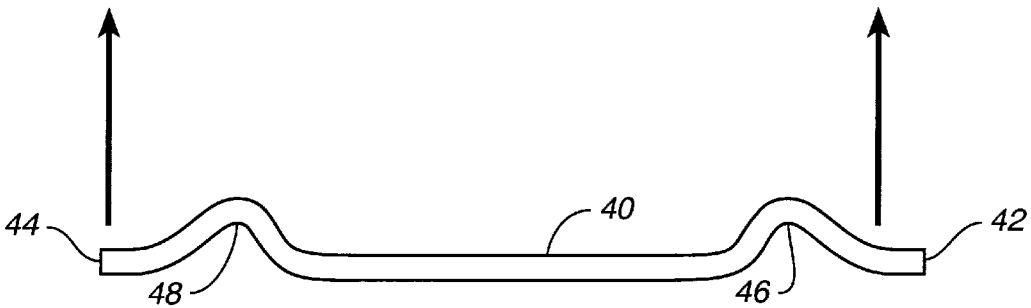
FIG. 3*b* is a top view of the crooked loom of the present invention.

FIG. 3*b* is a top view of the crooked loom of the present invention, having a right crooked segment 46 and a left crooked segment 48. When employed in an unfeathered doubled-bladed kayak paddle, the loom 40 is rotated 90 degrees from front to back so that the plane of the crooked segment is substantially perpendicular to the surface of the blades to which it is connected.

Figure 4:
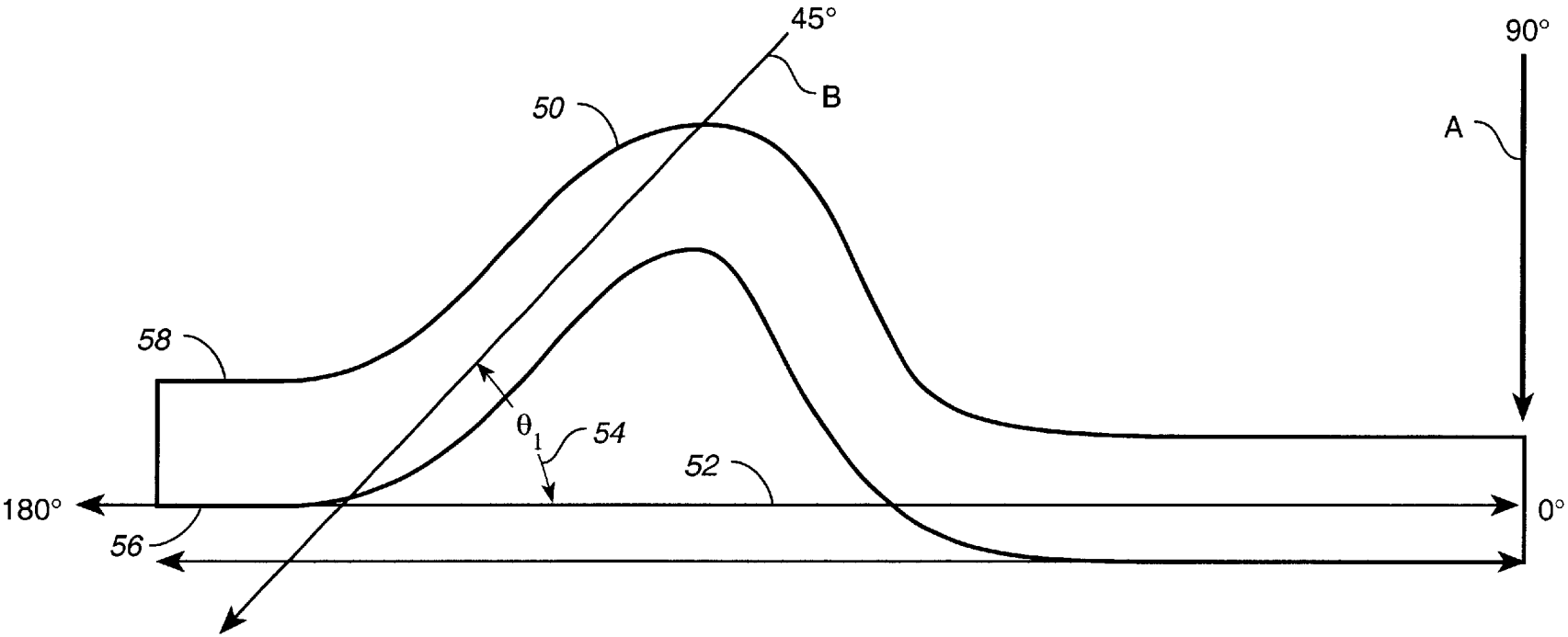
FIG. 4 is a top view showing detail of the crooked section of the loom of the present invention.

Detail of the left end of said loom is shown in the top view of FIG. 4. This loom configuration provides added leverage to the paddle blade when in use by changing the stroke force applied to the blade from the conventional 90 degrees, arrow A, to substantially 45 degrees, arrow B. The crooked segment 50 diverges from the longitudinal axis 52 of the loom and converges back in the same plane at substantially a 45 degree angle 54, sym.sub.1. Preferably the inferior border 56 of the most distal portion 58 of said crooked segment merges with and runs parallel to the longitudinal axis 52 of the loom.

The crooked loom may be molded at manufacturing into a fully integrated feathered configuration. Alternatively, the loom may be comprised of a plurality of detachable segments which may be positioned so as to achieve feathering of the blades relative to one another while maintaining the optimum 45 degree angle relative to the blade faces. Any number of suitable means for connecting said segments may be employed, as is well known in the art, and such may include lock stops or tension actuated positioning mechanisms for securing selected and tailored positions. In a single bladed embodiment, as in a canoe or raft oar, relative positioning of blades is unnecessary.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A contoured paddle for use in propelling shallow draft water craft, said paddle comprising:

at least one blade having a top edge, a bottom edge, proximal and distal ends, a front paddling surface, and a back surface, said front paddling surface having an asymmetrical surface topography for channeling water across said front paddling surface when in use, wherein said surface topography comprises a plurality of channel dividers defining a plurality of fluted channels, said channel dividers and fluted channels channeling water across the geometric center of said front paddling surface to the edges of said blade; and a paddle shaft connected to the at least one blade and having a handle portion for gripping by the user.

2. A contoured paddle for use in propelling shallow draft water craft, said paddle comprising:

at least one blade having a top edge, a bottom edge, proximal and distal ends, a front paddling surface, and a back surface, said front paddling surface having surface topography for channeling water across said front paddling surface when in use, and at least one curled upper edge portion comprising a segment of said upper edge and curling inwardly toward said front paddling surface, wherein said surface topography comprises a plurality of channel dividers defining a plurality of fluted channels, said channel dividers and fluted channels channeling water across the geometric center of said front paddling surface to the edges of said blade; and a paddle shaft connected to the at least one blade and having a handle portion for gripping by the user.

3. A contoured paddle as in claim 2 wherein said at least one blade is curved from its proximal to distal ends when viewed on edge.

4. A contoured paddle as in claim 2 wherein said at least one blade is curved in every direction about a center of curvature located at substantially the geometric center of said blade.

5. A contoured paddle as in claim 2 wherein said at least one blade is flat from its proximal to distal ends when viewed on edge.

6. A contoured paddle as in claim 2 wherein said paddle has one blade.

7. A contoured paddle as in claim 6 wherein said paddle shaft is substantially straight.

8. A contoured paddle as in claim 6 wherein said paddle shaft includes a crooked segment at its distal end immediately proximate to said paddle blade, said crooked segment diverging in a bend from the longitudinal axis of the shaft in a plane substantially perpendicular to the plane of said front paddling surface and converging back in the same plane at a substantially 45 degree angle, bending at its most distal portion so that its end is parallel with the longitudinal axis of said shaft, and thereafter connecting with said blade.

9. A contoured paddle as in claim 2 wherein said paddle has two blades comprising a right blade and a left blade.

10. A contoured paddle as in claim 9 wherein said paddle shaft is substantially straight.

11. A contoured paddle as in claim 9 wherein said paddle shaft includes a first crooked segment at the right distal end and a second crooked segment at the left distal end, each of said crooked segments immediately proximate to its respective paddle blade, said crooked segments diverging in a bend from the longitudinal axis of said shaft in a plane substantially perpendicular to the plane of said front paddling surface of its connected blade and converging back in the same plane at a substantially 45 degree angle, bending at its most distal portion so that its end is parallel with the longitudinal axis of said shaft, and thereafter connecting with said blade.

12. A contoured paddle for use in propelling shallow draft water craft, said paddle comprising:

at least one blade having a top edge, a bottom edge, proximal and distal ends, a front paddling surface, and a back surface, said front paddling surface having surface topography for channeling water across said front paddling surface when in use, wherein said surface topography comprises a plurality of channel dividers defining a plurality of fluted channels, and at least one curled upper edge portion comprising a segment of said upper edge and curling inwardly toward said front paddling surface, said channel dividers and fluted channels channeling water across the center of propulsive force of said front paddling surface to the edges of said blade so as to increase stroke efficiency and to reduce user fatigue; and a paddle shaft connected to the at least one blade and having a handle portion for gripping by the user.

13. A contoured paddle as in claim 12 wherein said at least one blade is curved from its proximal to distal ends when viewed on edge.

14. A contoured paddle as in claim 12 wherein said at least one blade is curved in every direction about a center of curvature located at substantially the geometric center of said blade.

15. A contoured paddle as in claim 12 wherein said at least one blade is flat from its proximal to distal ends when viewed on edge.

16. A contoured paddle as in claim 12 wherein said paddle has one blade.

17. A contoured paddle as in claim 16 wherein said paddle shaft is substantially straight.

18. A contoured paddle as in claim 16 wherein said paddle shaft includes a crooked segment at its distal end immediately proximate to said paddle blade, said crooked segment diverging in a bend from the longitudinal axis of said paddle shaft in a plane substantially perpendicular to the plane of said front paddling surface and converging back in the same plane at a substantially 45 degree angle, bending at its most distal portion so that its end is parallel with the longitudinal axis of said paddle shaft, and thereafter connecting with said blade.

19. A contoured paddle as in claim 12 wherein said paddle has two blades comprising a right blade and a left blade.

20. A contoured paddle as in claim 19 wherein said paddle shaft is substantially straight.

21. A contoured paddle as in claim 19 wherein said paddle shaft includes a first crooked segment at the right distal end and a second crooked segment at the left distal end, each of said crooked segments immediately proximate to its respective paddle blade, said crooked segments diverging in a bend from the longitudinal axis of said paddle shaft in a plane substantially perpendicular to the plane of said front paddling surface of its connected blade and converging back in the same plane at a substantially 45 degree angle, bending at its most distal portion so that its end is parallel with the longitudinal axis of said paddle shaft, and thereafter connecting with said blade.

* * * * *